US008142095B1

(12) United States Patent
Cutler

(10) Patent No.: US 8,142,095 B1
(45) Date of Patent: Mar. 27, 2012

(54) SPONGE WITH SOAP SLEEVE AND METHOD OF USE THEREOF

(76) Inventor: Renee J. Cutler, Aurora, CO (US)

( * ) Notice: Subject to any disclaimer, the term of this patent is extended or adjusted under 35 U.S.C. 154(b) by 1153 days.

(21) Appl. No.: 11/986,826

(22) Filed: Nov. 27, 2007

(51) Int. Cl.
*A47K 7/02* (2006.01)

(52) U.S. Cl. ..... 401/201

(58) Field of Classification Search ..... 401/201, 401/196, 6, 207
See application file for complete search history.

(56) References Cited

U.S. PATENT DOCUMENTS

| | | | | |
|---|---|---|---|---|
| 1,854,415 | A * | 4/1932 | Miller | 401/201 |
| 2,588,773 | A * | 3/1952 | Smith | 401/201 |
| 3,428,405 | A * | 2/1969 | Posner | 401/201 |
| 3,488,126 | A * | 1/1970 | Avallone | 401/8 |
| 3,768,916 | A | 10/1973 | Avery | |
| 4,457,643 | A | 7/1984 | Caniglia | |
| 4,969,225 | A | 11/1990 | Schubert | |
| 5,704,723 | A * | 1/1998 | Salisian | 401/8 |
| D392,433 | S | 3/1998 | Norris | |
| 5,857,792 | A | 1/1999 | Iffinger | |
| 6,326,339 | B1 | 12/2001 | Rattinger et al. | |
| 6,368,003 | B1 | 4/2002 | Sorrell | |
| 6,663,309 | B2 | 12/2003 | Zamansky | |
| 6,783,294 | B2 | 8/2004 | Duden et al. | |
| 7,014,381 | B1 * | 3/2006 | Graham | 401/201 |

* cited by examiner

*Primary Examiner* — David Walczak
(74) *Attorney, Agent, or Firm* — Montgomery Patent & Design, LLC; Robert C. Montgomery; Joseph T. Yaksich

(57) ABSTRACT

A sponge-like device with an internal cavity for receiving a carrier for liquid and solid soaps. The exterior of the carrier has a variety of design models and shapes; however, the carrier is sized to receive a conventional solid bar of soap or an amount of liquid soap. The carrier has a plurality of drain holes to allow the soap solution, as it mixes with the water during bathing, to drain onto the sponge. The use of the device is for washing oneself, children, invalids, as well as for scrubbing household surfaces like decks and siding, and also for cleaning motor vehicles all without the disadvantages associated with separate sponges and soap material.

3 Claims, 4 Drawing Sheets

SPONGE WITH SOAP SLEEVE AND METHOD OF USE THEREOF

RELATED APPLICATIONS

The present invention was first described in Disclosure Document No. 607,428 filed Oct. 16, 2006, the entire disclosures of which are incorporated herein by reference.

FIELD OF THE INVENTION

This invention relates to shower and bathing implements and, more particularly, to a soap-holding sponge for use during showering and bathing procedures.

BACKGROUND OF THE INVENTION

Just about everyone's daily ritual includes that of a shower or bath. Hopefully, in most cases, this ritual includes the use of soap. While soap has been around since almost the beginning of civilization, the disadvantages associated with its use have not really been worked out. Perhaps the greatest of these disadvantages is that of its slipperiness. This trait often causes soap to fall to the floor where it is difficult to find and perhaps even more difficult to pick up, especially those who may be elderly or disabled. Also, soap is typically used with a sponge or washcloth which requires the use of two hands, especially when applying the soap to the sponge or washcloth. Once again, this is not always process. Finally, in the case of bar soaps, it eventually gets too small where upon it is useless and must be discarded, thus wasting money as well.

Several attempts have been made in the past to design a means for use of soap and a sponge in one convenient apparatus. U.S. Pat. No. 3,768,916 in the name of Avery discloses a scrubbing unit that includes a sponge with a frangible ampoule containing a liquid soap disposed within a slot in the sponge. A cap fits on the sponge over the slot and pinches in the sides of the sponge to compress a portion of the sponge across the ampoule and thereby close the slot. This prevents fragments of the broken ampoule from coming out of the sponge and helps to directionalize the flow of soap through the sponge by reducing the permeability of the sponge adjacent the cap. Unfortunately, this prior art example does not provide a means for also housing a bar of soap.

U.S. Pat. No. 4,457,643 in the name of Caniglia discloses a soap and sponge washing device for washing the body in a shower or bath that includes a container forming an envelope for a bar of soap. Discrete openings through to the container interior allow water access to the soap and the facile exiting of lather for washing purposes, and a tab-like locking strip is integral with the container material for locking the soap in the container. Preferably there is a plurality of openings and preferably the tab lock is "T"-shape or truncated arrow-shape and is lockable into an opening in the container to block the entrance thereof. Unfortunately, this prior art example does not provide a means for housing liquid soap.

U.S. Pat. No. 4,969,225 in the name of Schubert describes bathing and cleansing articles to contain a bar of soap for use during bathing, cleansing, and the like. Unfortunately, this prior art example does not provide a means for housing liquid soap.

None of the prior art particularly describes a sponge with soap sleeve. Accordingly, there exists a need for a means by which soap and a sponge can be used together without the disadvantages as described above. The present invention satisfies such a need by providing an apparatus that is convenient and easy to use, lightweight yet durable in design, and designed for use during showering and bathing procedures. The sponge with soap sleeve is available in a variety of shapes and sizes and is designed to produce lather quickly. The sponge may also be used on household surfaces. The present invention is simple to use, inexpensive, and designed for many years of repeated use.

SUMMARY OF THE INVENTION

In view of the foregoing disadvantages inherent in the prior art, it has been observed that there is need for a sponge with soap sleeve.

The present invention comprises a sponge with an internal cavity for a bar of soap or for retaining liquid soap. Various models would be provided for use on oneself, washing children, washing automobiles or the like. Upon initial of the invention, it appears like any other common sponge. However, after closer observation, it can be seen that a cylindrical cavity is provided into the sponge into one of its narrow faces. The cavity is large enough to accept a common sized bar of body soap. It is envisioned that the sponge would stretch to hold a new bar, and gradually contract as the soap is used, such that the soap is held securely throughout its lifecycle. Liquid soap could also be poured into the cavity where it would be absorbed into the sponge material and work its way to the surface during use. The use of the present invention not only makes it easier to wash oneself, others or motor vehicles, but also saves soap, prevents dropped soap and eliminates other disadvantages associated with separate sponges and soap material.

A soap-holding sponge includes a carrier for holding at least one soap therein. Such a carrier includes a pair of coextensively shaped and opposed mounting walls, a pair of side walls monolithically formed with each of the mounting walls and spanning therebetween, and a closure rotatably attached to each of the pair of mounting walls respectively. The carrier further includes a compartment effectively defined within the mounting walls and the side walls and the closure respectively. Such a compartment is for storing the soaps and dispensing a soapy lather during operating conditions. The carrier further includes a pivot member located at the connection point of the mounting walls and the closure respectively for allowing the compartment to fully envelop a synthetic surfactant introduced therein.

The carrier further includes a plurality of solid and liquid soaps introduced into the compartment of the carrier. The closure is rotatably lifted upwardly and lowered downwardly to open and closed positions respectively thereby permitting insertion and removal of the solid and liquid soaps into the compartment of the carrier. The carrier further includes a plurality of dispersing holes integrally distributed on a major portion of each of the mounting walls. Each of such dispersing holes is conveniently in fluid communication with the compartment, and an entrance slot is in fluid communication with the compartment for receiving the soaps interiorly therein. A plurality of snaps is monolithically formed in the closure.

The soap holding sponge further includes a cleansing envelope removably surrounding the carrier. The carrier is formed from rigid material while the cleansing envelope is formed from water-absorbing and deformably resilient material respectively. Such a cleansing envelope includes a substantially rectangular-shaped sponge enclosure with a cavity formed therein. The envelope further includes a top face, an aperture formed in the top face and in fluid communication with the cavity of the enclosure, a front face connected to the top face, and a pair of opposed side faces. Each of such side faces is advantageously connected to the top face and the front face respectively. The envelope further includes a rear face, where such a rear face is connected to the top face and each of the side faces respectively.

The soap holding sponge further includes a means for hanging the device. Such a hanging means effectively includes a handle permanently and rotatably attached to the carrier and a handle mount connected directly to respective uppermost portions of each of the sidewalls and the handle respectively.

A method for utilizing a soap-holding sponge includes the steps of: opening an entrance slot located in a carrier via rotating a closure about a pivot member; inserting a selected one of a plurality of soaps into a compartment of the carrier by utilizing the entrance slot; closing the entrance slot by rotatably closing the closure; fastening the closure by utilizing a plurality of snaps formed in the closure; inserting the carrier into a cavity of a cleansing envelope by utilizing an aperture formed in the cleansing envelope; wetting the sponge; agitating the sponge and water flowing therethrough respectively to cause creation of a lather; rubbing and motioning the sponge in at least one direction selected from a group of directions including upwardly, downwardly, sidewardly, rotationally, and a combination thereof to apply the lather to a skin surface of a user; rinsing the sponge with fluid; and hanging the sponge to dry after use on a support surface via a handle attached to the carrier.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
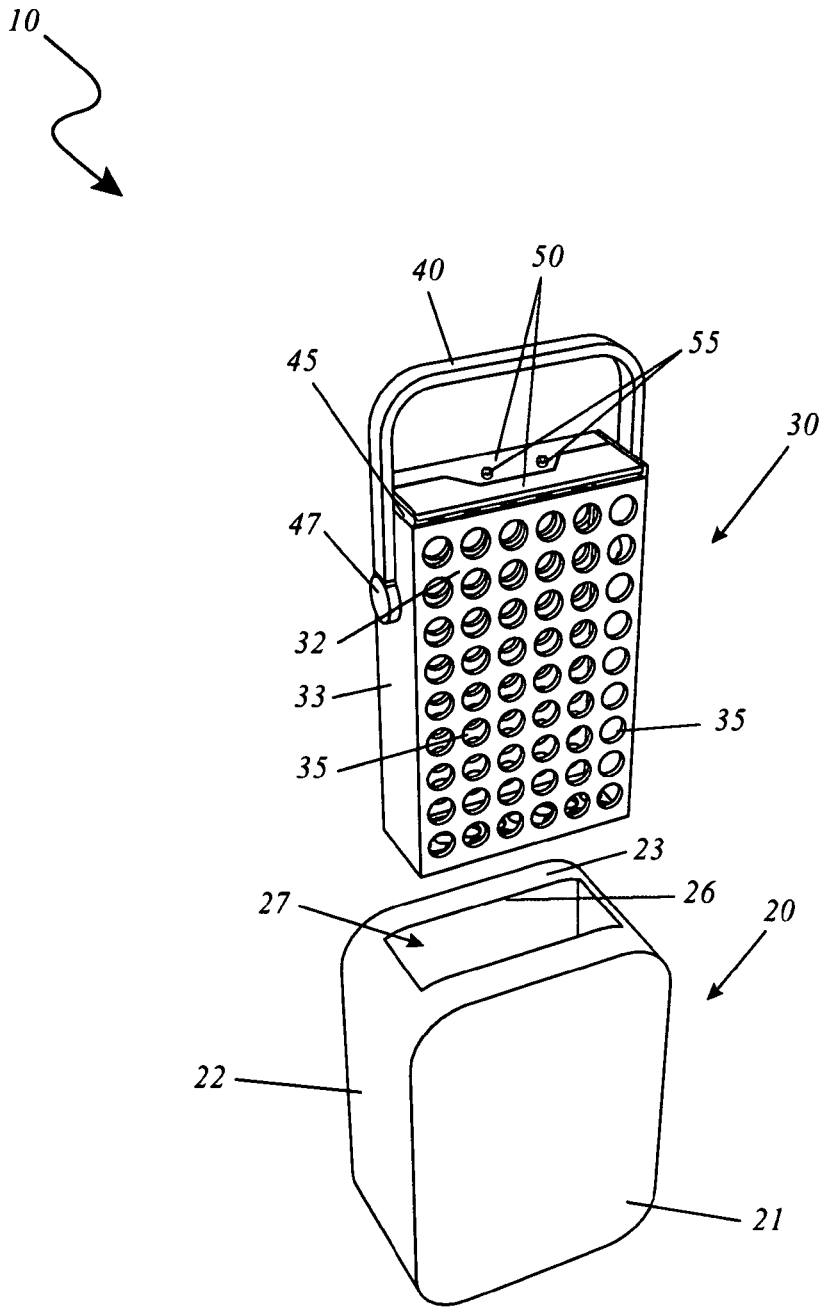
FIG. 1 is a perspective view of a cleansing envelope 20 with a carrier 30 insertably removed therefrom, according to the preferred embodiment of the present invention.

| | |
|---|---|
| 10 | sponge with soap sleeve |
| 20 | cleansing envelope |
| 21 | front face |
| 22 | side face |
| 23 | top face |
| 25 | rear face |
| 26 | aperture |
| 27 | cavity |
| 30 | carrier |
| 31 | entrance slot |
| 32 | mounting wall |
| 33 | sidewall |
| 35 | dispersing hole |
| 37 | compartment |
| 40 | handle |
| 45 | pivot |
| 47 | handle mount |
| 50 | closure |

-continued

| | |
|---|---|
| 55 | snaps |
| 60 | soap |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method that removably receives and retains a carrier 30 for the internal holding of a solid and/or liquid soap cleanser 60. The sponge with soap sleeve (herein described as the "device") 10 comprises a cleansing envelope 20, a carrier 30, and means for hanging the device 10. The cleansing envelope 20 is envisioned to be fabricated of a plurality of natural or synthetic sponge material and/or a combination thereof. A cavity 27 is formed therein said cleansing envelope 20 which may be added in the molding process or may be added later by a drilling or cutting process. A carrier 30 is envisioned to be fabricated of a plurality of resilient and/or rigid substances such that it can be removably inserted therein said cavity 27 while retaining soaps 60, lotions, and/or other desirable substances.

Referring now to FIG. 1, a perspective view of the cleansing envelope 20 with a carrier 30 insertably removed therefrom, is disclosed according to a preferred embodiment of the present invention. A cleansing envelope 20 takes the form of a rectangular sponge enclosure with an aperture 26 cut therethrough the top face 23 to serve as an entrance to a cavity 27 for containing a carrier 30, a front face 21, a bottom face (not pictured), two (2) side faces 22, and a rear face 25; however, the cleansing envelope 20 may also be introduced in a plurality of shapes such as, but not limited to: cylindrical, square, or other shapes. The cleansing envelope 20 is envisioned to be substantially rectangular in a plurality of dimensions to accommodate a carrier 30 of various sizes and forms therein an aperture 26 that leads to a cavity 27 for supporting said carrier 30. As an alternate embodiment, the side faces 22 of the cleansing envelope 20 may be concavely curved thereby providing a narrower area for facilitating secure grasping of the device 10, especially during bathing. The aperture 26 is sized accordingly to removably receive the carrier 30 and to substantially surround said carrier 30. The top face 23 comprises the aperture 26 for insertion of the carrier 30 therein the cleansing envelope 20.

Figure 2:
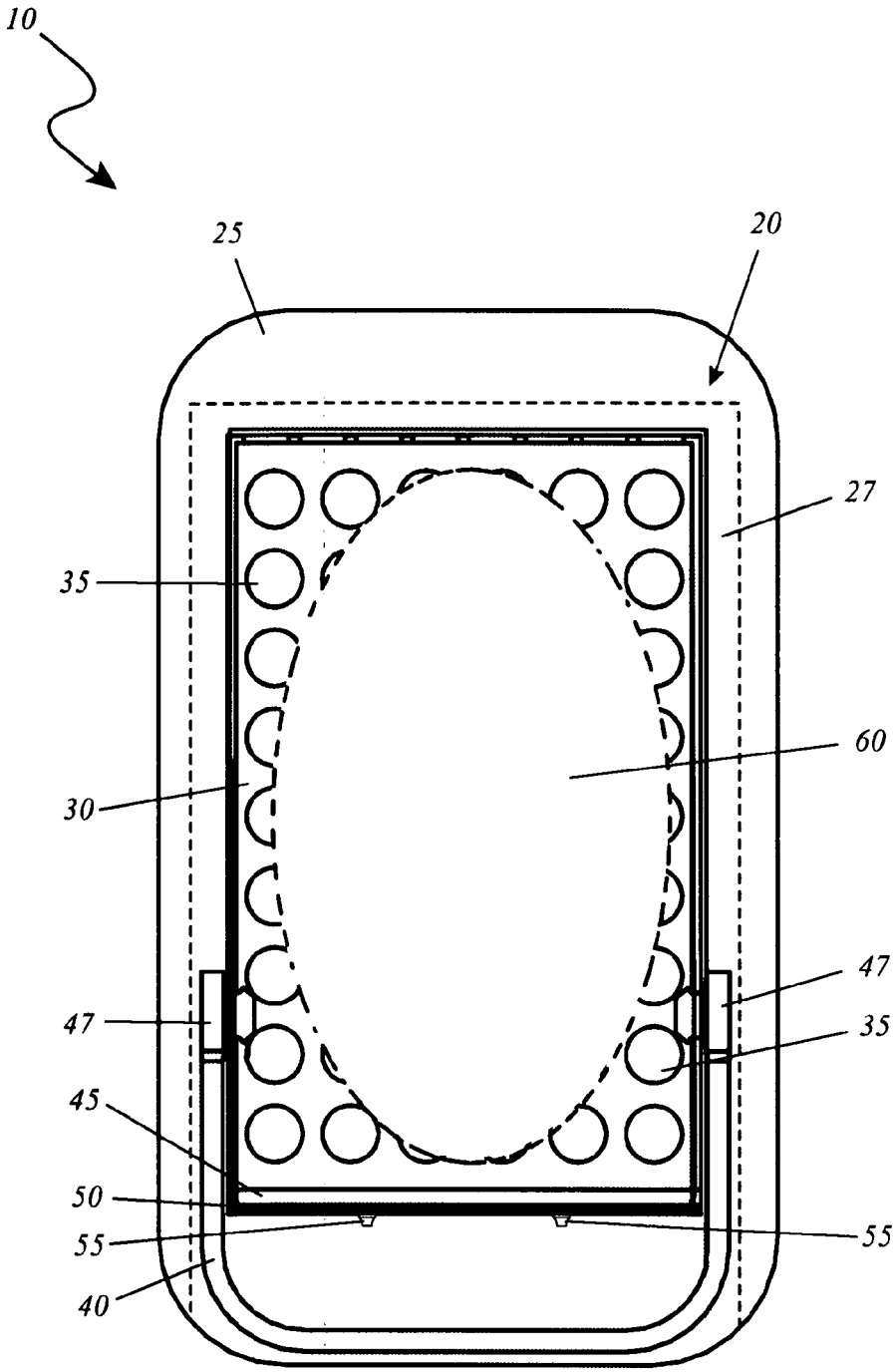
FIG. 2 is a rear cut-away view of a sponge with soap sleeve 10 with a soap member 60 removably inserted therein, according to the preferred embodiment of the present invention.
Figure 3:
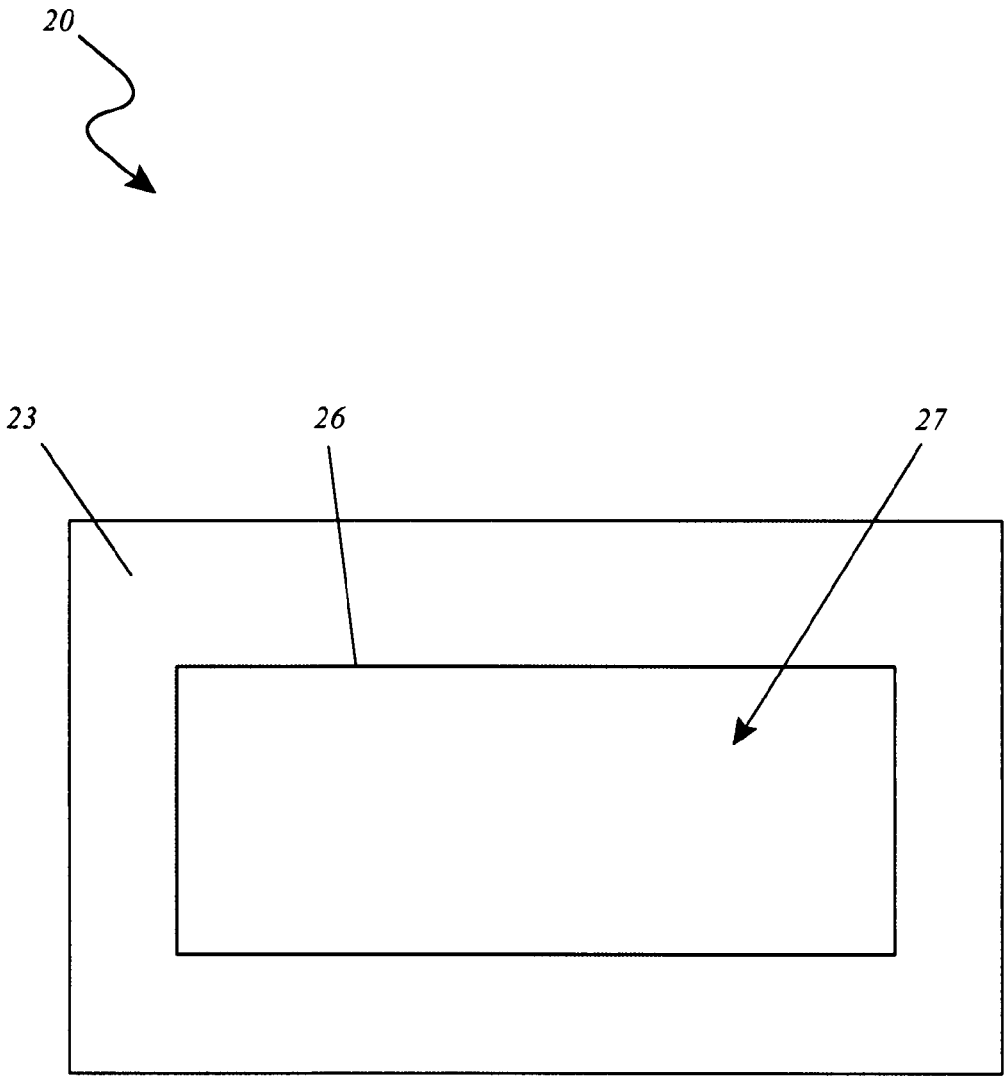
FIG. 3 is a top view of the cleansing envelope 20, according to the preferred embodiment of the present invention; and, FIG. 4 is a top view of the carrier 30, according to the preferred embodiment of the present invention.

Referring now to FIGS. 2 and 3, views of the device 10, are disclosed according to the preferred embodiment of the present invention. The cleansing envelope 20 is envisioned to be in a form of a sponge enclosure introduced in a variety of and/or combination of natural or synthetic sponge material that is porous to water and air. However, the cleansing envelope 20 can be fabricated out of any material from absorbent and stretchable to abrasive or combination thereof. For instance, one (1) side of the cleansing envelope 20 may comprise a softer sponge material with the opposing side comprising a sponge material slightly more abrasive. The abrasive side may comprise a plurality of protuberances, embossments, and/or debossments of various sizes and shapes, such as, but not limited to, circular, cone-shaped, squared, polygonal, other desirable shapes, and a combination thereof. The protuberances may be facing inward toward the cavity 27 or outward.

However, the materials utilized for the device 10 are envisioned to be made from any suitable flexible material having a comfortable degree of porosity whilst still being absorbent, soft, and comfortable and providing structural integrity and strength for continuous and repeated use. The cleansing envelope 20 is envisioned to permit water passage therethrough for procuring a lathering effect during utilization of the device 10. The type and size of the sponged material is envisioned to vary in accordance with the type of cleanser, capability of rinsing, release rate of cleansing and/or moistening substance, amount of lather desired, and/or other user preferences. The textured qualities of the cleansing envelope 20 provide an improved grip thereby reducing risk of slippage, which is common amongst soap bars 60. It further prevents the formation of a mush-like substance, which typically forms on a wetted soap bar 60 thereby reducing the wear rate of said soap bar member 60.

The device 10 is envisioned to comprise a carrier 30 that may vary in size, shape, and configuration with a closure 50 rotatably attached thereto two (2) mounting walls 32 via a pivot 45 thereby providing the ability and capacity to fully envelop a synthetic surfactant, one (1) or more solid soaps 60, or mixtures of both that vary in size, shape, and design. The carrier 30 is envisioned to be soft and flexible and able to be refilled with soap 60, lotion, cream, and so on. Thus, the device 10 carries the supply of liquid and/or solid soap cleanser 60 therein. The carrier 30 may be formed from the same category of material as the cleansing envelope 20, or may be a separate material all together. The carrier 30 is envisioned to comprise a compartment 37 that contains the ability and capacity to store soap 60 and dispense a soapy lather. The compartment 37 retains a quantity of soap 60, lotion, or the like therewithin for directing and subsequent application of the soapy lather onto a user utilizing a plurality of dispersing holes 35 integrally distributed thereon. The carrier 30 defines an interior compartment 37 for housing the soap 60 with an entrance slot 31 for receiving said soap 60 interiorly therein said carrier 30, and hence the cleansing envelope 20.

The soap 60 is contained therein said carrier 30 to which is later disposed within the absorbent cleansing envelope 20 so that, when the device 10 is massaged or manipulated, a soapy lather is released into the cleansing envelope 20 therethrough the dispersing holes 35 thereby producing a lather for use in cleansing the skin. The carrier 30 takes the form of a compartment 37 by which a soap member 60 is inserted and secured therein by snaps 55, hook-and-loop fasteners, or other temporary means thereby fully enclosing said soap member 60. The carrier 30 preferably, but not essentially, comprises a sizeable compartment 37 thereby permitting free movement of soap member 60 and/or other cleansing substances for maximum lathering effect. The carrier 30 is designed to enclose a plurality of and/or combination of soaps 60 such as, but not limited to, beads, slivers or chips, a bar, a ball, gel, flakes, pellets, chips, other desirable soaps 60, and/or combinations thereof. Alternatively, the user may also use liquid soap instead of or in combination with the solid soap member 60.

The carrier 30 may be instigated in a plurality of dimensions to accommodate soap 60, moisturizers, lotions, and the like of various amounts and sizes with an entrance slot 31 that is selectively opened or closed via the closure 50 that is slightly larger than that of said entrance slot 31. The closure 50 is rotatably coupled thereto the two (2) mounting walls 32 via a proper pivot mechanism 45 that allows said closure 50 to be engaged to said mounting walls 32 and capable of rotatably lifting upwardly and lowering downwardly to open and close thereby permitting the insertion or removal of the soap 60. Further, snaps 55 are situated on the closure 50 to releaseably secure said closure 50 over the entrance slot 31 thereby retaining the soap 60 therein, thus preventing the soapy lather from flowing undesirably out of the aperture 26 and directing toward the scrubbing surface of the cleansing envelope 20. An alternate embodiment of the carrier 30 may comprise clasps, locking mechanisms, fasteners, catches, or other detachedly affixing mechanisms to releaseably secure the soap 60 therein.

Figure 4:
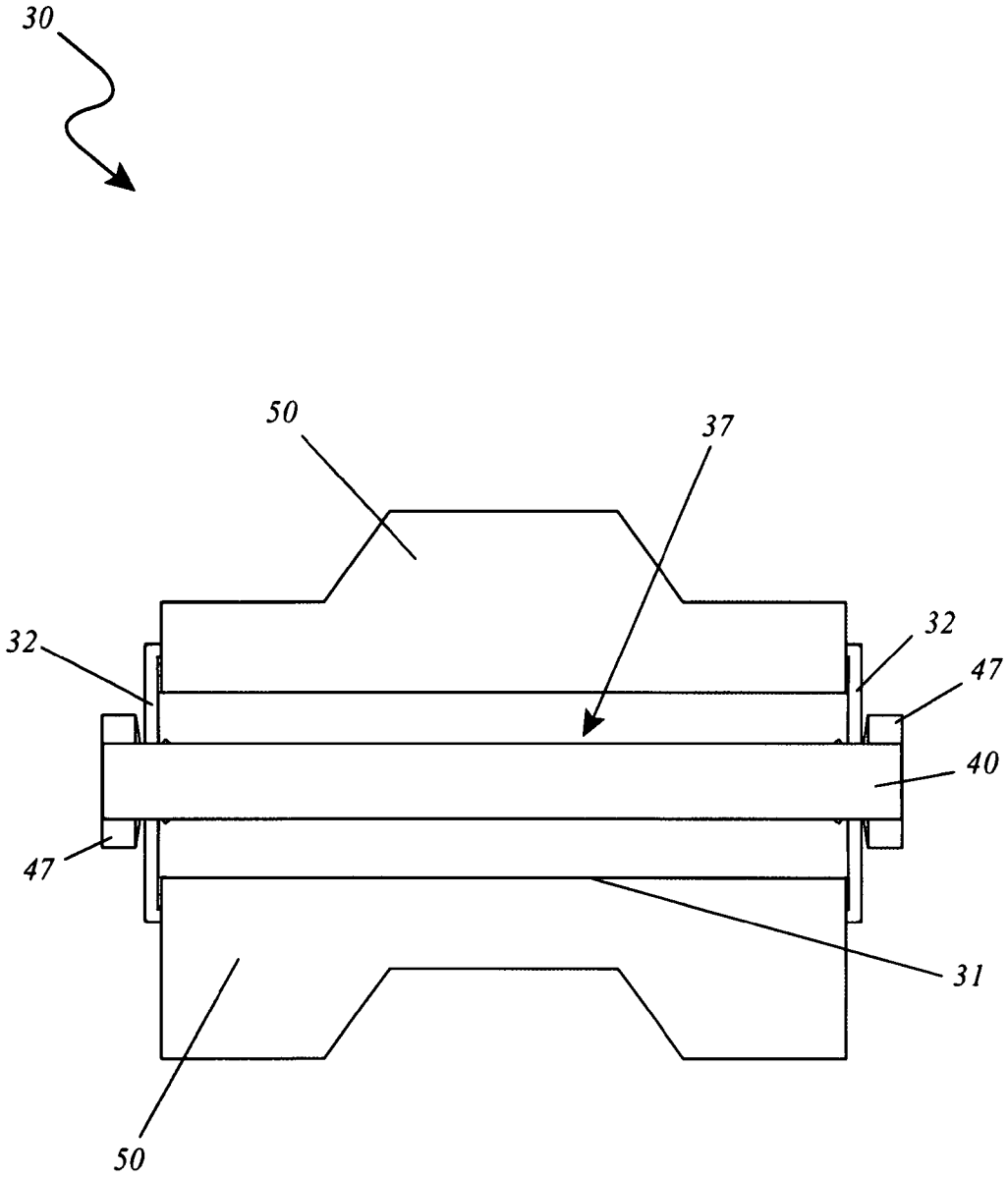

Referring now to FIG. 4, a top view of the carrier 30 is disclosed according to the preferred embodiment of the present invention. The carrier 30 is envisioned to comprise a plurality of holes 35, slots, slits, or other openings operably position therealong the entire or partial volume of the carrier 30 for receiving moisture for further improving the lathering effect. A plurality of dispersing holes 35 is operably positioned therealong the entire or partial volume of the carrier 30. The holes 35 functions in an innovative manner to directionalize the flow of a soapy fluid toward the cleansing envelope 20 thereby enabling a soap lather to permeate therethrough said cleansing envelope 20 more readily.

The dispersing holes 35 are throughout the carrier 30 extending from the exterior surface of said carrier 30 through to the interior surface to the compartment 37. The dispersing holes 35 are envisioned to be relatively circular, as depicted in FIG. 1, but may be of any other cross-sectional shapes, such as, but not limited to, polygonal, square, triangular, rectangular, and more. The holes 35 are inserted throughout the carrier 30 to allow the soap solution, as it mixes with the water during bathing, to drain onto the cleansing envelope 20. The dispersing holes 35 also function as receiving means for receiving water therein the compartment 37 for generating the lather. Further, the dispersing holes 35 enable airflow to reach the soap 60 after usage so that the drying of the soap 60 may be expedited thereby increasing the longevity of the soap 60 and decreasing the possibility of mold or mildew accumulating.

The cleansing envelope 20 and/or the carrier 30 may also be introduced with a variety of aesthetically pleasing motifs and/or other images imprinted or stamped thereon such as, but not limited to, cartoon characters, sport logos, and/or other caricatures. The device 10 may also be introduced in a variety of shapes and sizes with or without the option of it being fashioned to resemble effects such as, but not limited to, animals, characters, and/or other images. The cleansing envelope 20 and/or the carrier 30 may also be introduced in a plurality of shapes such as, but not limited to, oval, heart, pear, square, triangle, polygon, rectangle, star, and/or other shapes. In addition, the cleansing envelope 20 and/or the carrier 30 may be introduced with or without writing imprinted, stamped, or the like thereon for identification purposes, quotes, and/or other personal or impersonal embroidery. It is also envisioned that multiple colors and styles would be made available to match all bathroom decors or the like.

A handle 40 is envisioned to be permanently and rotatably attached thereto the carrier 30 via a handle mount 47 at the respective uppermost portion of the sidewalls 33 to assist in the insertion and/or removal of said carrier 30 therefrom the aperture 26 of the cleansing envelope 20 as well as to provide a means to attach to impermanent fixtures such as a hook, for example, for hanging or holding after use. The handle 40, envisioned to be a plurality of lengths, widths, and/or other dimensions, may be utilized after use for the quick drying of carrier 30 and/or cleansing envelope 20, used to hang the device 10 for decoration, or fragrantly odorize the air with essence if fragrant items are placed therein the carrier 30, and so on. The handle 40 may further comprise a sleeve or the like providing a soft, comfortable grasping surface for the user. To place the device 10 in an area that is convenient, the handle 40 may be utilized to hang the device 10 thereon a hook or other hanging members on a wall or other partition.

An alternate embodiment of the present invention may provide a means for inserting fragrant materials therein the carrier 30 and using it as an air freshener to freshen a room, luggage, confined areas, an opened area, or other regions.

Another alternate embodiment of the present invention may be utilized as other solid cleansers for carpet, furniture, and such. The cleansing chemicals may be inserted therein the carrier 30 and secured therein by utilizing the snaps 55 on the closure 50. The carrier 30 may then be inserted therein the cleansing envelope 20 for application. After use, the device 10 may then be cleansed and reused for other applications.

Yet another alternate embodiment of the present invention may comprise the device 10 being used as a massaging agent by which massaging balls, beads, or other objects are inserted therein the carrier 30 or the aperture 26 of the cleansing envelope 20.

The preferred embodiment of the present invention can be utilized by the common user in a simple and effortless manner with little or no training. After initial purchase or acquisition of the device 10, it would be configured as indicated in FIGS. 1 through 4.

The method of utilizing the device 10 may be achieved by performing the following steps: rotatably opening the entrance slot 31 via rotating the closures 50 about the pivots 45; inserting one (1) or a plurality of soap 60 bars, balls, beads, slivers, and other soap members 60 therein the compartment 37 of the carrier 30 by utilizing the entrance slot 31; reclosing said entrance slot 31 by rotatably closing the closure 50; fastening said closure 50 by utilizing the snaps 55, hook-and-loop fasteners, such as Velcro□, or other temporary fastening means; removably inserting the carrier 30 therein the cavity 27 of the cleansing envelope 20 by utilizing the aperture 26; wetting the device 10; agitating the device 10, whereas the agitation and water flowing therethrough causes creation of a lather; rubbing and motioning the device 10 upwardly, downwardly, sidewardly, rotationally, and a plurality of other directions to apply said lather thereon the skin in preferred areas; rinsing the device 10 with water or other fluid; and, hanging the device 10 to dry after use thereon a hook, or other hanging devices utilizing the handle 40.

The device 10 is envisioned to administer amounts of soaps 60, gels, body wash, balms, creams, oils, and/or similar substances to the surface of the skin. The carrier 30 resides therein the cleansing envelope 20 and is preferably flexible for easy manipulation, refillable, and washable. The carrier 30 comprises a plurality of dispersing holes 35 for the soapy solution to flow therethrough for saturation of the cleansing envelope 20 to be delivered onto the skin of the user. The cleansing envelope 20 collects and absorbs the dispensed soapy solution therefrom the dispersing holes 35.

Essentially, the device 10 is utilized for the application and dispensing of a soapy lather to skin areas. The device 10 is sized and designed for a smooth and comfortable application while still being washable and easily stored. With the closure 50 unlocked thereby allowing free access through the entrance slot 31 to the compartment 37, a bar of soap 60 may be inserted therein. Thereafter, the closure 50 may be closed and locked via snaps 55. The carrier 30 may then be inserted therein the cavity 27. After utilization, the carrier 30 may then be removed by grasping the handle 40 and lifting upwardly.

It will be further appreciated that the device 10 may be used for washing a plurality of surfaces other than the skin of a user such as, but not limited, furniture, vehicles, walls, and more.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A soap-holding sponge for assisting a user to cleanse selected body parts during showering and bathing conditions, said soap-holding sponge comprising:

a carrier for holding at least one soap member therein;

a cleansing envelope removably surrounding said carrier, said carrier being formed from rigid material while said cleansing envelope is formed from water-absorbing and deformably resilient material respectively; and, means for hanging said carrier;

wherein said carrier comprises a pair of coextensively shaped and opposed mounting walls;

a pair of side walls monolithically formed with each of said mounting walls and spanning therebetween;

a closure rotatably attached to each of said pair of mounting walls respectively;

a compartment defined within said mounting walls and said side walls and said closures respectively, said compartment for storing the soap member and dispensing a soapy lather during operating conditions; said closures being rotatably lifted upwardly and lowered downwardly to open and closed positions respectively thereby permitting insertion and removal of solid and liquid soaps into said compartment of said carrier; and, a pivot member located at a connection point of said mounting walls and said closures respectively for allowing said compartment to fully envelop a synthetic surfactant introduced therein;

wherein said hanging means comprises:

a handle permanently and rotatably attached to said carrier; and, a handle mount connected directly to respective uppermost portions of each of said sidewalls and said handle respectively; and, wherein said handle is U-shaped, said handle having first and second side arms oppositely spaced apart and located at opposed sides of said side walls, said handle further having a linear top arm fixedly connected to said first and second side arms such that said top arm extends parallel to a major width of said closures respectively.

2. The soap-holding sponge of claim 1, wherein said cleansing envelope comprises:

a substantially rectangular-shaped sponge enclosure having a cavity formed therein;

a top face;

an aperture formed in said top face and being in fluid communication with said cavity of said enclosure;

a front face connected to said top face;

a pair of opposed side faces, each of said side faces being connected to said top face and said front face respectively; and, a rear face, said rear face being connected to said top face and each of said side faces respectively.

3. The soap-holding sponge of claim 2, wherein said carrier further comprises:

a plurality of solid and liquid soaps introduced into said compartment of said carrier, a plurality of dispersing holes integrally distributed on a major portion of each of said mounting walls, each of said dispersing holes being in fluid communication with said compartment;

an entrance slot in fluid communication with said compartment for receiving said soaps interiorly therein; and, a plurality of snaps monolithically formed in said closure.

* * * * *